United States Patent [19]

Taylor

[11] 3,992,204

[45] Nov. 16, 1976

[54] METHOD AND MEDIUM FOR PRODUCING ELECTROSTATIC CHARGE PATTERNS

[75] Inventor: Allen L. Taylor, Woodbury Township, Washington County, Minn.

[73] Assignee: Minnesota Mining & Manufacturing Company, St. Paul, Minn.

[22] Filed: Aug. 6, 1973

[21] Appl. No.: 385,849

[52] U.S. Cl. ..... 96/1.5; 96/1 R; 96/1.2

[51] Int. Cl.[2] ..... G03G 5/04

[58] Field of Search ..... 96/1.5, 1 R, 1.2; 313/14

[56] References Cited

UNITED STATES PATENTS

| | | | |
|---|---|---|---|
| 3,677,751 | 7/1972 | Ohta | 96/1 R |
| 3,713,822 | 1/1973 | Kiess | 96/1.5 |
| 3,719,481 | 3/1971 | Makino | 96/1.5 |
| 3,775,104 | 11/1973 | Matsumoto | 96/1 R |

*Primary Examiner*—David Klein
*Assistant Examiner*—Judson R. Hightower
*Attorney, Agent, or Firm*—Alexander, Sell, Steldt & DeLaHunt

[57] ABSTRACT

An electromagnetic radiation sensitive copy medium and method for producing positive or negative copies electrostatically. In a first embodiment the copy medium includes a poled, radiation transmissive, pyroelectric insulative layer, an electrically conductive layer, and a photoconductive layer interposed between and electrically connected with the insulative and conductive layers. A second embodiment includes two insulative layers, a photoconductive layer that is interposed between the insulative layers, and an electrically conductive layer that is juxtaposed with one of the insulative layers. A third embodiment is basically similar to the first embodiment except that it includes a plurality of photoconductive layers, each being sensitive to a single, but different, color of light. The method disclosed for producing electrostatic copies with the above embodiments is also employable with prior art copy mediums that have ordinary insulative layers instead of the pyroelectric insulative layers of the present invention.

36 Claims, 8 Drawing Figures

METHOD AND MEDIUM FOR PRODUCING ELECTROSTATIC CHARGE PATTERNS

BACKGROUND OF THE INVENTION

1. Field of the Invention

The present invention relates in general to electromagnetic copy mediums and the method for producing positive and negative copies electrostatically and more specifically to such mediums that are formed of an insulative top layer, an electrically conductive bottom layer, and a photoconductive layer interposed between the insulative and electrically conductive layers.

2. Description of the Prior Art

A number of patents disclose processes for producing electrostatic images by the employment of multi-layer copy mediums having an insulative layer, an electrically conductive layer, and a photoconductive intermediate layer. Such disclosures are taught in patents to Hall, U.S. Pat. No. 3,234,019, Watanabe et al. U.S. Pat. Nos. 3,457,070 and 3,536,483, and Zweig, U.S. Pat. No. 3,722, 992. These patents also teach the transfer of an image produced on the surface of the photoconductive layer to the surface of the insulative layer in order that the image is preserved irrespective of an exposure to light. Image transfers to the surface of the insulative layer are also advantageous to avoid the dissipation of the image forming voltages through conduction across the photoconductive layer.

It is also known in the art to employ a crystalline photoconductive-pyroelectric compound together with an electrically conductive layer to form a copy medium as disclosed in patent to Kiess, U.S. Pat. No. 3,713,822. To produce a copy by the use of such a medium in accordance with the teachings of the Kiess patent, first the photoconductive-pyroelectric compound is heated in the dark to develop a positive electrostatic charge on one surface of the compound and a negative electrostatic charge on the opposite surface. Thereupon, the charged compound is exposed to a light image, which converts the exposed image areas from a low conductivity to a high conductivity, permitting the negative and positive charges of the exposed areas to combine. This results in a reduction of surface charge in the exposed areas to produce an electrostatic latent image charge pattern on the photoconductivepyroelectric compound. However, when a charge representative of the image is formed on the photoconductive layer, it musst be immediately developed to avoid dispersion of charge as the result of an unintentional exposure of the photoconductive layer to light or a breakdown of that layer.

The present invention provides for an improved copy medium and process using the medium for producing an image on the surface of an insulative layer by means of an image transfer from the surface of a photoconductor, with such process also being usable with other prior art copy mediums.

SUMMARY OF THE INVENTION

The present invention provides an improved process for producing an electrostatic, latent image on the surface of an electrically insulative layer forming a top portion of a copy medium that also includes a bottom electrically conductive layer and an intermediate photoconductive layer. With the electrically conductive layer grounded an image is produced by first charging the upper surface of the insulative layer with an electrostatic charge, transferring a portion of the charge to the electrically grounded conductive layer and selectively exposing the photoconductive layer.

The present invention also provides an improved reusable copy medium that in one embodiment is formed of a poled, electrically insulative layer of pyroelectric material, an electrically conductive layer, and a photoconductive layer interposed between and electrically connected to the pyroelectric layer and the electrically conductive layer. When the photoconductive layer is exposed to light the conductivity of the photoconductive layer is increased so that it serves as a path of conduction between the pyroelectric insulative layer and the conductive layer.

In another embodiment, the present invention is formed of a copy medium that includes two layers of poled, pyroelectric material, a photoconductive layer that is interposed between the pyroelectric layers, and an electrically conductive layer that is juxtaposed with one of the pyroelectric layers in order to furnish a higher density of charge and, accordingly, copies with high resolution.

In yet another embodiment, the present invention is formed of a pyroelectric insulative layer and an electrically conductive layer between which a plurality of photoconductive layers are positioned, each photoconductive layer being sensitive to a different color of a color group to enable the production of a color copy.

By the utilization of poled, pyroelectric insulative layers in the above embodiments, the first step of the disclosed process, which is that of charging the pyroelectric insulative layer which with an electrostatic charge, is performed by changing the temperature of the pyroelectric layer from its ambient temperature. Due to the poling of the pyroelectric layer, the change of temperature results in the formation of an electrostatic charge on that layer and eliminates the need for external charging devices that previously were required to charge prior copy mediums.

The foregoing and other advantages of the present invention will appear from the following description. In the description reference is made to the accompanying drawings, which form a part hereof, and in which there is shown by way of illustration, and not of limitation, specific forms in which the invention may be embodied. Such embodiments do not represent the full scope of the invention, but rather the invention may be employed in a variety of embodiments, and reference is made to the claims herein for interpreting the breadth of the invention.

DESCRIPTION OF THE PREFERRED EMBODIMENTS

Figure 1:
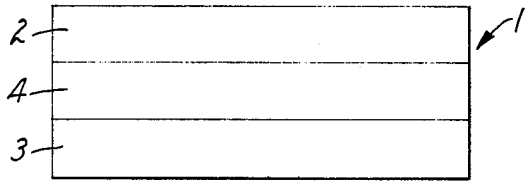
FIG. 1 is a diagrammatic view of a prior art electrostatic copy medium.

Referring now to the drawings, a heretofore known copy medium 1 is shown in FIG. 1 for producing electrostatic latent image charge patterns using the process of this invention. The copy medium 1 includes a top, radiation transmissive, electrically insulative layer 2, a bottom electrically conductive layer 3, and an intermediate photoconductive layer 4 having intimate, surface-to-surface contact with the layers 2 and 3. A detailed discussion of the composition of the medium 1 is set out following the examples of this disclosure.

To produce an electrostatic image on the copy medium 1, using the method of this invention, first an overall uniform positive surface charge is formed on the upper surface of the insulative layer 2, and the layer 3 is electrically connected to ground. Such charging may be accomplished by the use of a corona charging unit or other such charging device. This step preferably is performed with the photoconductive layer 4 wholly exposed to the type of radiation that increases its conductivity. In this way, negative charges, substantially equal in number to the number of positive charges on the upper surface of the layer 2, are attracted from ground via the conductive layer 3 and the photoconductive layer 4 to the lower surface of layer 2. This result may also be achieved by the use of a photoconductive layer that need not be radiation exposed to permit negative charges to pass therethrough from the conductive layer to the insulative layer.

Figure 2:
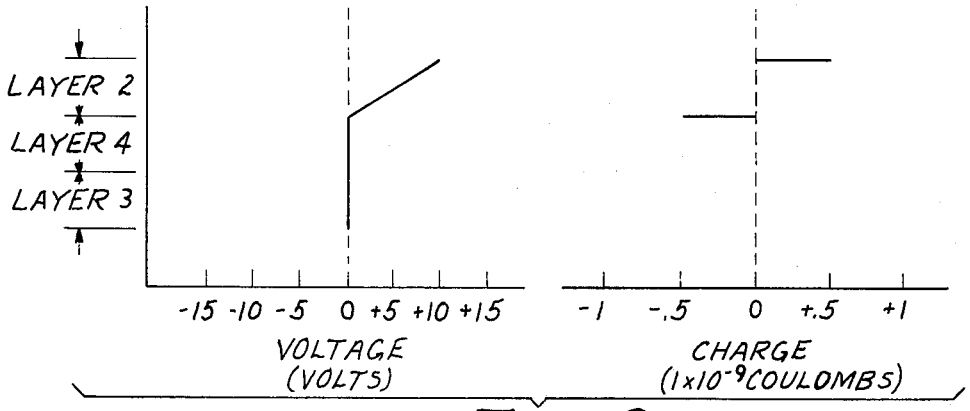
FIG. 2 is a graphical representation of the charge and voltage of the copy medium of FIG. 1 after a first step of the method of the present invention is performed.

FIG. 2 is a graphic illustration of the charge distribution and voltage potential of the layers 2, 3 and 4 immediately after charging. The charges shown therein are distributed such that a quantity of positive charges are on the upper surface of the insulative layer 2 and are balanced by an equal number of negative charges on the lower surface of the layer 2 to form a number of positive-negative charge pairs. The voltage potentials of the medium 1 are such that the upper surface of the layer 2 has a positive potential and the lower surface of the layer 2 has a substantially zero potential because it is operatively connected to the grounded layer 3 by the photoconductive layerr 4, which is either exposed to radiation to make it conductive or is inherently conductive to pass negative charges in the direction of the layer 2.

The next step in the process is to neutralize the upper surface of the layer 2 in the absence of radiation by electrically grounding the layer 2 with a grounded Pluton brush, or other such device that will effectively connect the entire upper surface of the layer 2 to ground. An A. C. corona or other ionizing techniques may also be employed. Neutralization reduces the number of positive charges on the upper surface of the layer 2 because some of them are drained to ground, the remainder of the positive charges are prevented from draining to ground because of their attraction for the negative charges on the lower surface of the layer 2.

Reduction of the positive charges at the upper surface of the layer 2 disrupts the balance between the positive-negative charge pairs of the layer 2. To regain such balance, positive charges are attracted from ground to the upper surface of the conductive layer 3 by the negative charges of the layer 2 no longer balanced by positive charges. The amount of redistribution of positive charges that occurs when the upper surface of the layer 2 is grounded is dependent on the capacitance of each of the layers 2 and 4. For example, if the layers 2 and 4 have an equal capacitance, then half of the positive charges that are initially impressed on the upper surface of the layer 2 will be distributed to the upper surface of the layer 3, as illustrated in the graph of charge and voltage potential of FIG. 3.

Figure 3:
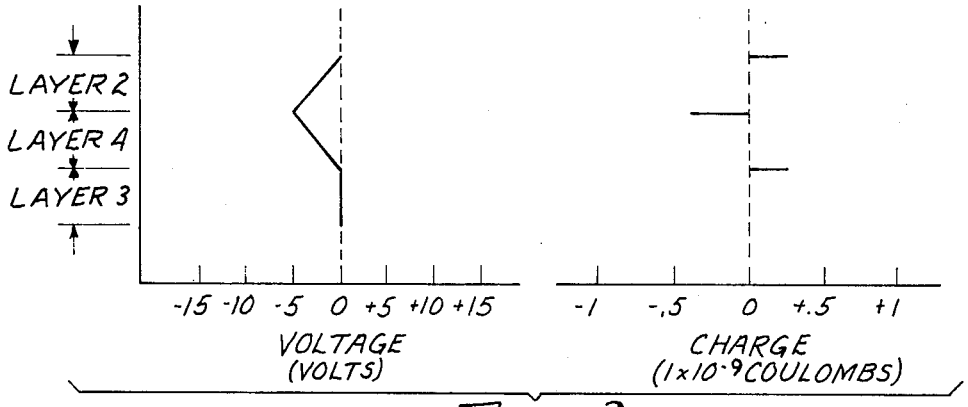
FIG. 3 is a graphical representation of the charge and voltage of the copy medium of FIG. 1 after a second step of the method of the present invention is performed.

As can be discerned from FIG. 3, connecting the upper surface of layer 2 to ground reduces the voltage of that surface to zero with respect to ground. However, as would result in a capacitor when only one plate is grounded while the other plate is allowed to float, the voltage with respect to ground on the lower surface of the layer 2 is driven to a negative value to maintain the potential across the upper and lower surfaces of the layer 2 that existed before the grounding of the upper surface.

After the upper surface of the layer 2 is neutralized, its connection with ground is removed and the layer 4 is selectively exposed to radiation, such as a light image, which increases the conductivity of the exposed image areas of the layer 4. Those areas of the bottom surface of the layer 2 that are aligned with the exposed areas of the layer 4 are thereby essentially connected to the grounded layer 3, allowing the positive charges on the upper surface of the layer 3 in areas registered with the exposed areas of the layer 4 to flow through the photoconductive layer 4 and combine with corresponding negative charges on the bottom surface of the layer 2. As shown in the charge and voltage graph of FIG. 4, this flow of charge between the layers 2 and 3 through the exposed areas of layer 4 eliminates the positive charges on the upper surface of the layer 3 and cuts in half the negative charges on the bottom surface of the layer 2. In addition to this change in charge in the exposed areas, the relative voltage potentials across the layers 2 and 4 also change, as indicated in FIG. 4.

Figure 4:
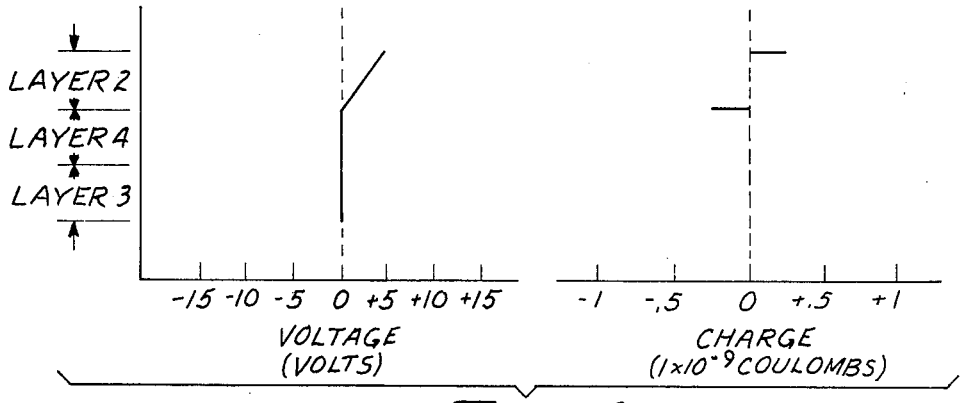
FIG. 4 is a graphical representation of the charge and votage of the copy medium of FIG. 1 after a third step of the present invention is preformed.

From a comparison of FIGS. 3 and 4, it is seen that the potential difference between the exposed and nonexposed areas at the upper surface of the layer 2 is equal to one-half the original charging voltage. This result is again due to the capacitive operation of the insulative layer 2 which causes the upper surface of layer 2 to increase in voltage potential when the bottom surface of the layer 2 is connected to ground. The potential difference between the exposed and the nonexposed areas at the layer 2 produces electrostatically charge patterns representative of the radiation image which can be developed by the use of conventional toner powder techniques.

Figure 5:
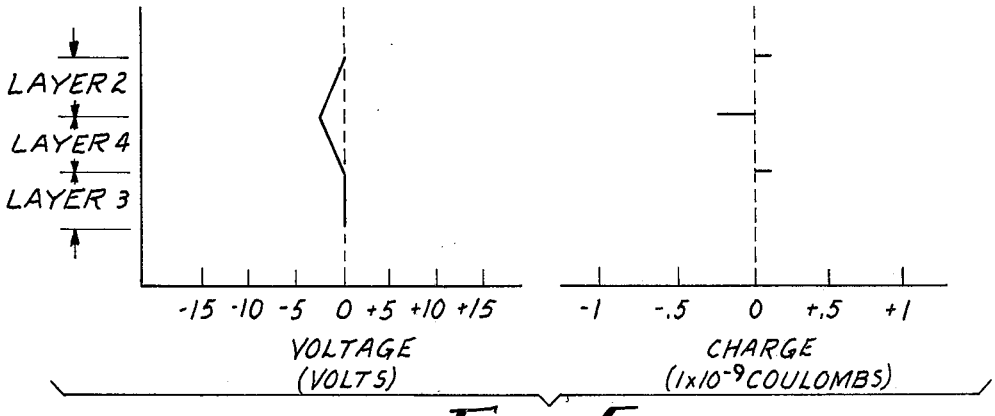
FIG. 5 is a graphical representation of the charge and voltage of the copy medium of FIG. 1 after a fourth step of the present invention is performed.

The voltage developed in the exposed areas is of a greater magnitude than that of the nonexposed areas. To reverse the voltage magnitude in the exposed areas the additional steps of neutralizing the insulative layer 2 and then flooding the photoconductive layer 4 with radiation must be performed. As previously described, neutralization of the upper surface of the layer 2 consists of connecting that surface to ground so that the positive charges of the exposed areas are distributed between the upper surfaces of the layers 2 and 3 in accordance with the capacitance thereof. FIG. 5 illustrates the charge and voltage of the exposed areas of the layers 2, 3 and 4 after neutralization has been completed. Since the charge and voltage of the areas not exposed, as shown in the graph of FIG. 3, have not been changed since the first neutralization step, these areas are not affected by this second neutralization.

At this point, both the exposed and nonexposed areas at the top surface of the layer 2 are at zero potential with respect to ground, and the corresponding areas of the lower surface of the layer 2 have a low negative voltage and a high negative voltage respectively with respect to ground. Thus, when the next step of flooding with light is performed to ground the lower surface of the layer 2, to maintain the existing potential difference between the exposed areas of the upper and lower surface of the layer 2 and between the nonexposed areas of the upper and lower surface of the layer 2, the potential of the exposed areas of the upper surface of the layer 2 is raised to a low positive potential and the nonexposed areas float up to a relatively high positive potential. In this way a positive image formed by the exposed areas that are at a less potential than the nonexposed areas can be produced.

It is not essential to the present invention that the above described image producing steps of neutralizing, imaging and neutralizing be performed consecutively, instead, neutralizing and imaging can be performed substantially together to achieve nearly identical results. The only difference in the results is that in the former the charge and voltage of the exposed areas of the layers 2, 3 and 4 have a minimal charge and voltage potential, whereas in the latter these layers are all at substantially zero charge and potential.

Figure 6:
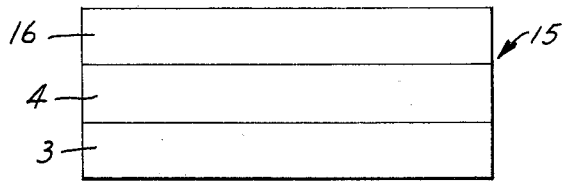
FIG. 6 is a diagrammatic view of a first embodiment of the present invention.

In addition to the variation of steps in the above described method for producing an electrostatic image, a number of other variations are made possible by the use of a reusable copy medium 15, shown in FIG. 6, that represents a first preferred embodiment of the present invention. The copy medium 15 is similar to the medium 1 except that a pyroelectric insulative layer 16 is substituted for the layer 2, as shown in FIG. 6. In all other respects, the copy medium 15 is identical to the copy medium 1.

The pyroelectric layer 16 may be thin sheets of polyvinylidene fluoride or ceramic plates of lanthanum-modified lead zirconate-titanate, with the dipoles of the layer 16 poled to be oriented in an aligned relationship. Although a few pyroelectric materials have dipoles that are naturally aligned in a poled relationship, normally the dipoles of pyroelectric materials are essentially arranged in random fashion. These dipoles can be rearranged in orientation when a pryroelectric material is heated above a particular temperature known as the poling temperature. When a pyroelectric material is heated above its poling temperature and an electric field is applied, the dipoles orient themselves in accordance with the field. The degree of dipole orientation is a function of the pyroelectric material's temperature, the applied field strength and the length of time the field is applied. For example, in polyvinylidene fluoride substantial poling begins when the film is heated to a temperature greater than 90° C and an electric field of at least about 4,000 volts per millimeter of thickness is applied for approximately 15 minutes when the material is above this temperature. Increasing the temperature and/or the applied field will increase the poling until saturation is reached.

Once the poled film is cooled below the poling temperature the field may be removed and the dipoles will remain as oriented by the applied field. Once poled, a pyroelectric material will thereafter produce opposite charges on its surfaces when it is heated or cooled beyond its ambient temperature. Care should be taken through to insure that the material is not heated above its poling temperature for extended periods in order that the dipoles are not permitted to return to a random orientation.

Thus, by the employment of the pyroelectric layer 16 the upper layer of the copy medium 15 may be charged merely by heating or cooling, and no external charging devices such as corona charging units are required as is the case for the prior art medium 1 of FIG. 1. The medium 15 should be heated or cooled beyond its ambient temperature sufficiently to provide opposite charges on the upper and lower surfaces of the layer 2, producing at least a 10 volt potential across the upper and lower surfaces of the layer 16. To avoid the problem of maintaining the layer 16 at the temperature to which it is heated or cooled in order that the developed charges are not reduced, it is preferable to discharge the layer 16 immediately subsequent to its heating or cooling. Discharging of the layer 16 may be performed by electrically shorting the upper and lower surfaces of the layer 16 together or by grounding the upper surface of the layer 16 and the layer 3 while the medium 15 is flooded with radiation. Such discharging removes all charges and potential from the layer 16 so that as it then returns to its ambient temperature, reverse charges are developed on the surface of the layer 16 producing a potential opposite to that first produced. Following such charging of the layer 16 the medium 15 may then be treated in the same manner as the medium 1 to produce an electrostatic charge pattern in accordance with selective exposure of the layer 16 to radiation.

The use of the pyroelectric material in forming the layer 16 provides a great deal of flexibility in producing the particular type of image desired because a positive image formed on the layer 16 may be converted into a negative image or vice versa by simply changing the temperature of the medium 15. Whether one heats or cools the medium 15 and the degree of heating and cooling depends on the previous steps employed in originally producing the image.

Figure 7:
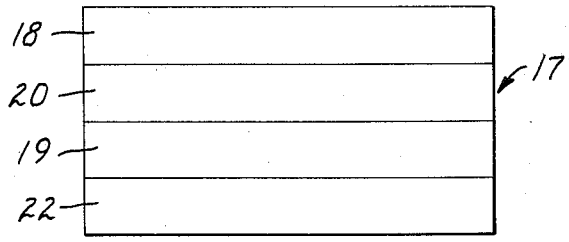
FIG. 7 is a diagrammatic view of a second embodiment of the present invention.

Referring now to FIG. 7, there is shown a copy medium 17 that represents a second preferred embodiment of the present invention. The copy medium 17 is formed of two poled, pyroelectric insulative layers 18 and 19 arranged with their dipole orientations in the same direction, a photoconductive layer 20 similar to the layer 4 in surface-to-surface contact with both the layers 18 and 19, and a conductive layer 22 similar to the layer 3 in intimate surface-to-surface contact with the insulative layer 19.

The method steps previously described for the copy medium 1 are equally applicable for use with the copy medium 17. Two of the advantages of using the medium 17 instead of the medium 1 is that the double insulative layer configuration furnishes faster imaging and more distinct resolution than that provided by the medium 1.

The forming of the medium 17 presents certain difficulties in bonding the various layers together that are not encountered in forming the medium 1. Generally, a photoconductor-binder-solvent layer coated on a pyroelectric layer bonds well and no significant bonding problems are encountered. However, bonding a second layer of pyroelectric to the photoconductive layer is more difficult. The second layer of the pyroelectric may be bonded to the photoconductive layer by using an epoxy cement with photoconductive material mixed therein. Care in forming the bond should be exercised to avoid bubbles, but bubbles can be removed if necessary to do so by known squeegee techniques. The conductive layer 22 can be bonded to the pyroelectric insulative layer 19 using a coating of metallic paint, such as silver, that may be sprayed, knife coated, or brushed evenly on the layer 19. Alternatively, the conductive layer 22 may be formed on the pyroelectric insulative layer 19 by sputtering or vaporizing a conductive metal layer thereon. As was true for the medium 1, the use of pyroelectric layers 18 and 19 in this embodiment provides the capability of charging the upper insulative layer 18 by the means of simply heating or cooling.

Figure 8:
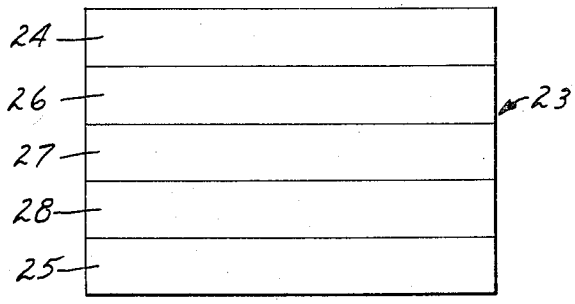
FIG. 8 is a diagrammatic view of a third embodiment of the present invention.

Referring now to FIG. 8, a copy medium 23 that represents a third preferred embodiment of the present invention is shown. The copy medium 23 is adapted to provide full color copies and includes an upper insulative layer 24, similar to the layer 2, a lower conductive layer 25, similar to the layer 3, and three light transmissive photoconductive layers 26, 27 and 28 stacked between the layers 24 and 25. Each of the photoconductive layers 26, 27 and 28 are sensitive to a different one of the three primary color components of a color group. For example, in the arrangement that will be described herein, the layers 26, 27 and 28 are sensitive to only the colors red, yellow and blue respectively. The use of three separate photoconductive layers is not essential to this embodiment and instead, a single layer could be employed containing interspersed groups of color sensitive areas, each group including at least one such area for each primary color.

To provide a color producing copy image with the medium 23, the same initial method steps of charging the insulative layer 24 and then neutralizing and imaging are employed, as previously described for the first embodiment. The only difference is that a color image must be used in the imaging step. During such imaging, the areas of the layers 26, 27 and 28 are exposed to the color image and respond to the particular colors present in the image to which they are sensitized, thereby decreasing the capacitance across the layers 26, 27 and 28 in those exposed areas. The decrease in capacitance in the exposed areas increases the voltage potential on the upper surface of the layer 24 in those areas. Because the upper surface of the layer 24 is neutralized during imaging the voltage variation thereon is removed so that there is no image pattern yet developed. However, subsequent sequential flooding of the medium 23 with each particular color for layers 26, 27 and 28 will produce an increase of potential of the upper surface of the layer 24 at the prior nonexposed areas, but the potential of the prior exposed areas in not changed. Accordingly, to establish the color image, the medium 23 is flooded with red, green and blue light, one color at a time. Immediately following the flooding of the medium 23 with a particular colored light, the upper surface of the layer 24 is powdered with a complementary colored toner powder. The toner powder is then transferred to a copy surface and the upper surface of the layer 24 is again neutralized before flooding by the next color. In this way, a color copy image is formed on the copy surface.

In correspondence to the copy medium 15, the meduim 23 may include a second pyroelectric insulative layer between the photoconductive layer 28 and the conductive layer 25 to decrease the time required for imaging and providing a more distinct resolution.

The following examples will serve to illustrate the invention with more particularity to those skilled in the art.

EXAMPLE 1

Gold electrodes were sputtered on both surfaces of a circular 0.050 mm. thick, biaxially oriented, polyvinylidene fluoride film until surface resistance was approximately one ohm/square. A wire lead was attached to each surface with silver conductive paste and the film was positioned in a frame to hold it rigid. The resultant film assembly was placed in an oven, heated to about 125° C, subjected to a 5,000 volt direct current electric field for about 15 minutes and cooled to 50° C while under the influence of the 5,000 volt field. The leads from the film surfaces were connected together and the film assembly was maintained at the temperature of 60° C for one hour. The film assembly was then removed from the oven and the film removed from the frame, and the gold coating was rubbed off the film by first rubbing with plain tissue paper and next with tissue paper soaked in acetone.

One face of the film was then knife coated with a 0.254 mm. wet thickness layer of the following photoconductive mixture:

| Component | Parts by Weight |
|---|---|
| cadmium sulfide (silver doped) | 21 |
| Pliolite S-7 | 0.66 |
| toluene | 28 |

Subsequently the photoconductive layer was air dried and NESA glass was attached thereto in face-to-face contact to form a three layer copy medium using a mixture of:

| Component | Parts by Weight |
|---|---|
| 3520 Epoxy Resin (6 pts B to 5 pts A) | 1 |
| cadmium sulfide | 1 |

An electrically grounded conductive lead was attached to the NESA glass with silver paste and the copy medium was then heated in the light to about 40° C above room temperature. An electrically grounded Pluton conductive brush was brushed across the surface of the film, which was then cooled to room temperature. The copy medium was transferred to a dark room and was exposed to a light pattern using a tungsten light intensity of 1.3 milliwatts/cm$^2$ for 0.4 seconds. During exposure, the grounded Pluton brush was swept over the film surface several times. The medium was then flooded with light, and subsequently the film was powdered with electrostatic toner powder by the use of conventional powder techniques. The resulting direct positive image of the exposure was transferred to paper by conventional offset transfer means to produce a positive image of the orginal that was then fixed by fusion.

EXAMPLE 2

The procedure outlined in Example 1 except that the photoconductive coating was a mixture of:

| Component | Parts by Weight |
|---|---|
| polyvinylcarbazole | 5 |
| trinitrofluorenone | 7 |
| tetrahydrofuran | 48 |

and a conductive silver spray paint coating was substituted for the NESA glass

EXAMPLE 3

The procedure outlined in Example 2 except that the photoconductive coating was a mixture of:

| Component | Parts by Weight |
|---|---|
| zinc oxide | 4.8 |
| Pliolite S-7 | 0.3 |
| toluene | 0.6 |

EXAMPLE 4

Gold electrodes were sputtered on both surfaces of two circular 0.050 mm. thick, biaxially oriented, polyvinylidene fluroide films until surface resistance was approximately one ohm/square. Wire leads were attached to each surface of the two films with silver conductive paste and the films were each positioned in frames to hold them rigid. The resultant film assemblies were placed in an oven, heated to about 125° C, subjected to a 5,000 volt direct current electric field for about 15 minutes and cooled to 50° C while under the influence of the 5,000 volt field. The leads from each surface of the films were connected together and the film assemblies were maintained at the temperature of 60° C for one hour. The films were then removed from the oven and one of the films was removed from its frame. The gold coating was rubbed off both films by first rubbing with plain tissue paper and next with tissur paper soaked in acetone.

One face of the film in the frame was then knife coated with a 0.254 mm. wet thickness layer of the following photoconductive mixture:

| Component | Parts by Weight |
|---|---|
| cadmium sulfide (silver doped) | 21 |
| Pliolite S-7 | 0.66 |
| toluene | 28 |

Subsequently the photoconductive layer was allowed to dry approximately 12 hours and was then taken from the frame. Next the noncoated film was ahered to the photoconductive layer in face-to-face contact using a mixture of:

| Component | Parts by Weight |
|---|---|
| 3520 Epoxy Resin (6 pts B to 5 pts A) | 1 |
| cadmium sulfide (silver doped) | 2 |

It was imperative that the orientation of the two films were the same. The ahered films were placed in a block, heated to about 65° C, rolled with a steel roller to squeeze out bubbles and excess epoxy mixture, and allowed to set for 24 hours. A spray coating of silver paint was then laid down on the uncoated surface of the second Mylar film.

The resultant copy medium was neutralized, exposed and developed to produce a positive image as described in Example 1 which image was then transferred to plain paper and fixed by heat fusion.

EXAMPLE 5

A 0.0254 mm. thick Mylar film was knife coated with a 0.254 mm. wet thickness layer of the following photoconductive mixture:

| Component | Parts by Weight |
|---|---|
| cadmium sulfide | 21 |
| Pliolite S-7 | 0.66 |
| toluene | 28 |

The photoconductive layer was air dried and then uniformly sprayed with a layer of silver paint. The resultant copy medium was placed with its silver layer on brass plate connected to ground.

Using a corona wire attached to −7500 volts, the upper surface of the Mylar film was uniformly charged by passing the corona wire about one inch therefrom. The charged upper surface was then neutralized in the dark by brushing with a grounded Pluton brush. The copy medium was subsequently exposed to a light pattern using a tungsten light intensity of 1 millijoule/cm$^2$ for 0.8 seconds. The film was then powdered in the dark with electrostatic toner powder by the use of conventional techniques to produce a negative image that was transferred to plain paper and heat fused thereto by conventional procedures.

EXAMPLE 6

A copy medium was prepared, corona charged, neutralized and exposed to a light pattern as outlined in Example 5. The copy medium was subsequently neutralized again in the dark, and then flooded with light to produce a latent positive image of the light pattern. Next, the medium was powdered in the light with electrostatic toner powder as described in Example 5 to produce a positive image that was transferred to plain paper and fixed by conventional procedures.

EXAMPLE 7

A 0.0254 mm. Mylar film was coated on one side with a layer of a photoconductive mixture and allowed to dry approximately 12 hours. An epoxy binder coating as described in Example 4 was hand coated on one side of a second 0.0254 mm. Mylar film to bind that film in face-to-face contact with the photoconductive layer in such fashion that both films have the same orientation. The bound films were placed on a heated block of about 65° C, rolled with a steel roller to squeeze out bubbles and excess epoxy mixture, and allowed to set for 24 hours. A silver paint coating was then laid down on the uncoated surface of the second Mylar film. The resultant copy medium was subsequently uniformly charged, neutralized and exposed to a light pattern as outlined in Example 5 to produce a latent negative image that was subsequently developed using electrostatic toner powder, transferred to plain paper and heat fused thereto by conventional procedures.

EXAMPLE 8

The copy medium outlined in Example 7 was prepared and uniformly corona charged as described in Example 5. The film was then neutralized in the dark with a grounded Pluton brush and simultaneously exposed to a light as described in Example 5. The medium was subsequently flooded with light to yield a latent positive electrostatic image that was developed using electrostatic toner. The resulting positive image was transferred to plain paper and heat fused by conventional procedures.

EXAMPLE 9

The procedure outlined in Example 5 except that the photoconductive coating consisted of a mixture of:

| Components | Parts by Weight |
|---|---|
| polyvinylcarbazole | 5 |
| trinitrofluorenone | 7 |
| tetrahydrofuran | 48 |

EXAMPLE 10

The procedure outlined in Example 5 except that the film employed was 0.050 mm. thick polyvinylidene fluoride.

EXAMPLE 11

The procedure outlined in Example 7 except that the film employed was 0.050 mm. thick polyvinylidene fluoride.

COMPOSITION OF MEDIUM 1

The insulative layer 2 of the medium 1 is preferably radiation transmissive and may be formed form a wide variety of insulative materials capable of accepting and retaining electrostatic charges on its surfaces such as cellulose acetate, polycarbonates, polytrifluorochloroethylene, polyvinyl chloride, polytetrafluoroethylene or commercially available films such as Mylar, Kapton, Teflon and KEL-F.

The photoconductive layer 4 may be uniformly coated on the insulative layer 2 in a conventional manner such as by being vaporized or sublimed onto the surface of the layer 2. A preferred coating comprises dispersing powdered photoconductor in a binder-solvent system and coating this mixture on the layer 2 using knife coating, roll coating or similar techniques. Examples of binders that may be utilized in such a coating are: Pliolite S-7, a copolymer of styrene and butadiene; VYHH, a copolymer of vinyl chloride and vinyl acetate; and Gelva V-100, polyvinyl acetate.

The photoconductive layer can be an inorganic compound, e.g. CdS, CdSe, $CdS_{1-x}$, $Se_x$, $TiO_2$, $As_2S_3$, $As_2S_{3-y}Se_y$, GaP, ZnO, ZnS, ZnTe, PbS, PbSe, InAs, $Hg_{1-x}Cd_xTe$, where $x$ is from 0 to 1, and $y$ is from 0 to 3. Organic photconductors such as polyvinylcarbazole can also be used. Selection of the photoconductor is dependent upon the radiation to be utilized in imaging and such radiation may be visible light, X-rays, gammarays, infrared rays, or ultraviolet rays. Tabulated below are some of the photoconductors that can be used with various types of radiation.

| Radiation | Photoconductors |
|---|---|
| Infrared | $Hg_{1-x}Cd_xTe$; PbS; PbSe; InAs where x = 0 to 1 |
| Visible | CdSe; GaP; ZnTe; CdS; ZnO; $TiO_2$; $As_2S_3$; |
| Ultraviolet | ZnS; ZnO |
| X-rays or γ-rays | Any of the above (may be doped with metal compound to improve absorption, for example heavy metals) |

The conductive coating 3 can be formed from NESA glass or a thin metal coating applied by such methods as spraying, sputtering, or conductive adhesive bonding. The radiation transmission characteristics of the conductive coating 3 may be poor if the insulative layer 2 is radiation transmissive. Otherwise the coating 3 must be radiation transmissive because it is essential that one of the layers 2 or 3 be transmissive to radiation.

What I claim is:

1. A process for producing a latent electrostatic charge pattern on the surface of an insulative layer forming a portion of a copy medium that also includes an electrically conductive layer, and a photoconductive layer that is interposed between said insulative layer and said electrically conductive layer, one of which insulative and conductive layers is radiation transmissive, which process comprises the steps of:

1. forming an electrostatic charge of one polarity on the upper surface of said insulative layer and an electrostatic charge of the opposite polarity on the lower surface thereof;
2. transferring a portion of the charge on the upper surface of said insulative layer to the elctrically conductive layer such that the voltage potential on the upper surface of said insulative layer becomes substantially zero with respect to said conductive layer; and
3. selectively exposing said photoconductive layer to radiation.

2. A process for producing a latent electrostatic charge pattern on the surface of an insulative layer forming a portion of a copy medium that also includes an electrically conductive layer, and a photoconductive layer that is interposed between said insulative layer and said electrically conductive layer, one of which insulative and conductive layers is radiation transmissive, which process comprises the steps of:

1. forming an electrostatic charge of one polarity on the upper surface of said insulative layer and an electrostatic charge of the opposite polarity on the lower surface thereof;
2. transferring a portion of the charge on the upper surface of said insulative layer to the electrically conductive layer;
3. selectively exposing said photoconductive layer to radiation; and
4. performing the transfer of said portion of the charge on the upper surface of said insulative layer to the electrically conductive layer and the selective exposure of said photoconductive layer substantially together, and then flooding the medium with radiation.

3. The process recited in claim 1 wherein the transfer of a portion of the charge on the upper surface of said insulative layer to the electrically conductive layer is followed by the selective exposure of said photoconductive layer.

4. The process recited in claim 1 wherein said insulative layer is electrically charged by a corona discharge.

5. A process for producing a latent electrostatic charge pattern on the surface of a poled pyroelectric insulative layer forming a portion of a copy medium that also includes an electrically conductive layer, and a photoconductive layer that is interposed between said insulative layer and said electrically conductive layer, one of which insulative and conductive layers is radiation transmissive, which process comprises the steps of:

1. changing the temperature of said insulative layer from an ambient temperature to form an electrostatic charge of one polarity on the upper surface of said insulative layer and an electrostatic charge of the opposite polarity on the lower surface thereof;
2. discharging the upper and lower surfaces of said insulative layer by momentarily shorting them together;
3. returning said insulative to an ambient temperature upon the discharge of the upper and lower surfaces of said insulative layer;
4. transferring a portion of the charge on the upper surface of said insulative layer to the electrically conductive layer; and
5. selectively exposing said photoconductive layer to radiation.

6. A process for producting a latent electrostatic charge pattern on the surface of an insulative layer forming a portion of a copy medium that also includes an electrically conductive layer and a photoconductive layer that is interposed between said insulative layer and said electrically conductive layer, one of which insulative and conductive layers is light transmissive, which process comprises the following steps:

1. forming an electrostatic charge of one polarity on the upper surface of said insulative layer an an electrostatic charge of the opposite polarity on the lower surface thereof;
2. momentarily electrically connecting the upper charged surface of said insulative layer to the electrically conductive layer while said medium is in the dark such that the voltage potential on the upper surface of said insulative layer becomes substantially zero with respect to said conductive layer; and
3. selectively exposing said photoconductive layer.

7. The process recited in claim 6 wherein the electrical connection of said upper charged surface of said insulative layer to the conductive layer and the selective exposure of said photoconductive layer are substantially performed together, and then said medium is flooded with light upon the removal of the connection between said upper charged surface and said conductive layer.

8. The process recited in claim 6 wherein the electrical connection between the upper charged surface of said insulative layer and the conductive layer is removed prior to the selective exposure of said photoconductive layer.

9. The process recited in claim 6 wherein the electrical connection of the upper charged surface of said insulative layer is removed during the selective exposure of said photoconductive layer but is momentarily replaced upon the completion of the said exposure and subsequently the photoconductive layer is entirely exposed.

10. The process recited in claim 6 wherein said insulative layer is electrically charged by a corona discharge.

11. The process recited in claim 6 wherein said insulative layer is formed from a poled, pyroelectric material and is charged by the method of:

1. electrically connecting said conductive layer to ground;
2. changing the temperature of said insulative layer from an ambient temperature;
3. electrically connecting the upper surface of said insulative layer to ground while said photoconductive layer is flooded with light; and
4. returning said insulative layer to said ambient temperature subsequent to the disconnection of the upper surface of said insulative layer from ground.

12. The process recited in claim 6 wherein said insulative layer is formed from a poled, pyroelectric material and is charged by the method of:

1. electrically connecting said electrically conductive layer to ground;
2. heating said insulative layer from an ambient temperature;
3. electrically connecting the upper surface of said insulative layer to ground while said photoconductive layer is flooded with light; and
4. cooling said insulative layer to said ambient temperature upon the disconnection of the upper surface of said insulative layer from ground.

13. The process recited in claim 6 wherein said insulative layer is formed from a poled, pyroelectric material and is charged by the method of:

1. electrically connecting said electrically conductive layer to ground;
2. cooling said insulative layer from an ambient temperature;
3. electrically connecting the upper surface of said insulative layer to ground while said photoconductive layer is flooded with light; and
4. returning said insulative layer to said ambient temperature upon the disconnection of the upper surface of said insulative layer from ground.

14. The process recited in claim 6 wherein said insulative layer is formed from a poled, pyroelectric material and is charged by the method of:

1. electrically connecting said electrically conductive layer to ground;
2. heating said insulative layer sufficiently to provide a voltage of at least 10 volts;
3. electrically connecting the upper surface of said insulative layer to ground while said photoconductive layer is flooded with light; and
4. cooling said insulative layer to an ambient temperature upon the disconnection of the upper surface of said insulative layer from ground.

15. The process recited in claim 6 wherein said insulative layer is formed from a poled, pyroelectric material and is charged by the method of:

1. electrically connecting said electrically conductive layer to ground;
2. cooling said insulative layer sufficiently to produce a voltage of at least 10 volts;
3. electrically connecting the upper surface of said insulative layer to ground while said photoconductive layer is flooded with light; and 4. heating said insulative layer to an ambient temperature upon the disconnection of the upper surface of said insulative layer from ground.

16. A process for producing a latent electrostatic charge pattern on the surface of a pyroelectric insulative layer forming a portion of a copy medium that also includes an electrically conductive layer, and a photoconductive layer that is interposed between said insulative layer and said electrically conductive layer, one of which is radiation transmissive, which process comprises the steps of:

1. electrically connecting said electrically conductive layer to ground;
2. heating said insulative layer sufficiently to provide a voltage of at least 10 volts across the upper and lower surfaces of the insulative layer;
3. discharging the upper and lower surfaces of said insulative layer by electrically shorting them together;
4. cooling said insulative layer to an ambient temperature upon the removal of the connection between the upper and lower surfaces of said insulative layer;
5. momentarily electrically connecting the upper charged surface of said insulative layer to ground; and
6. selectively exposing said photoconductive layer to radiation.

17. The process recited in claim 16 wherein the electrical connection between ground and the upper charged surface of said insulative layer is removed prior to the selective exposure of said photoconductive layer.

18. The process recited in claim 17 wherein the electrical connection of the upper charged surface of said insulative layer is momentarily replaced upon the completion of said selective exposure and subsequent to the momentary replacement of said connection, the photoconductive layer is flooded with radiation.

19. A process for producing a latent electrostatic charge pattern on the surface of a poled, pyroelectric insulative layer forming a portion of a copy medium that also includes an electrically conductive layer, and a photoconductive layer that is interposed between said insulative layer and said electrically conductive layer, one of which insulative and conductive layers is radiation transmissive, which process comprises the steps of:

1. electrically connecting said electrically conductive layer to ground;
2. cooling said insulative layer sufficiently to produce a voltage of at least 10 volts across the upper and lower surfaces of the insulative layer;
3. electrically connecting the upper surface of said insulative layer with said conductive layer while said medium is flooded with radiation;
4. heating said insulative layer to an ambient temperature upon the removal of the connection between the upper and lower surfaces of said insulative layer;
5. momentarily electrically connecting the upper charged surface of said insulative layer to ground; and
6. selectively exposing said photoconductive layer to radiation.

20. The process recited in claim 19 wherein said upper charged surface of said insulative layer is electrically connected to ground substantially together with the selective exposure of said photoconductive layer, and then the medium is flooded with radiation upon the removal of the connection of said upper charged surface to ground.

21. The process recited in claim 19 wherein the electrical connection between the upper charged surface of said insulative layer and ground is removed prior to the selective exposure of said photoconductive layer.

22. The process recited in claim 19 wherein the electrical connection of the upper charge surface of said insulative layer is removed during the selective exposure of said photoconductive layer but is momentarily replaced upon the completion of said exposure and subsequent to the momentary replacement of said connection, the photoconductive layer is flooded with radiation.

23. A process for producing a latent electrostatic charge pattern on the surface of a poled, pyroelectric insulative layer forming a portion of a copy medium that also includes an electrically conductive layer, and a photoconductive layer that is interposed between said insulative layer and said electrically conductive layer, one of which insulative and conductive layers is light transmissive, which process comprises the steps of:

1. electrically connecting said electrically conductive layer to ground;
2. heating said insulative layer sufficiently to provide opposite electrical charges on the upper and lower surfaces of the insulative layer producing a first voltage potential of at least 10 volts across the upper and lower surfaces of the insulative layer;
3. connecting the upper surface of the insulative layer to ground while said medium is flooded with light to remove the voltage potential across said insulative layer;
4. cooling said insulative layer to an ambient temperature upon the disconnection of the upper and lower surfaces of the insulative layer to again provide electrical charges on the upper and lower surfaces, of the insulative layer producing a second voltage potential of at least 10 volts across the upper and lower surfaces of the insulative layer, which potential is reversed from the first potential;
5. momentarily electrically connecting the upper charged surface of said insulative layer to ground to neutralize said upper surface by transferring a portion of the electrical charges on the upper surface of the insulative layer to the conductive layer; and
6. selectively exposing said photoconductive layer to permit the electrical charges on the conductive layer to combine with a portion of the charges on the lower surface of the insulative layer.

24. A process for producing a latent, electrostatic color image on the surface of a poled, pyroelectric insulative layer forming a portion of a copy medium that also includes an electrically conductive layer, and a plurality of photoconductive layers interposed between said insulative layer and said electrically conductive layer, one of which insulative and conductive layers is light transmissive, and each of said photoconductive layers is sensitive to a single but different color of light, which process comprises the steps of:

1. electrically connecting said electrically conductive layer to ground;
2. changing the temperature of said insulative layer from an ambient temperature;
3. momentarily electrically connecting the upper and lower surfaces of said insulative layer together;

4. returning said insulative layer to said ambient temperature upon the removal of the connection between the upper and lower surfaces of said insulative layer;
5. momentarily electrically connecting the upper charged surface of said insulative layer to ground, and selectively exposing said photoconductive layer with a colored image substantially at the same time;
6. flooding each of said photoconductive layers with the color to which each photoconductive layer is sensitive, one at a time;
7. subsequent to said flooding of each photoconductive layer, powdering the upper surface of said insulative layer with a colored toner powder to form a portion of the colored image on said insulative layer; and
8. transferring said portion of said colored image to a copy surface.

25. A process for producing a latent electrostatic charge pattern on the surface of a first radiation transmissive insulative layer forming a portion of a copy medium that also includes a photoconductive layer in surface-to-surface contact with and electrically connected to said first insulative layer, a second radiation transmissive insulative layer in surface-to-surface contact with and electrically connected to said photoconductive layer, and an electrically conductive layer in surface-to-surface contact with and electrically connected to said second insulative layer, which process comprises the following steps:

1. connecting said electrically conductive layer to ground;
2. forming an electrostatic charge of one polarity on the upper surfaces of said insulative layers and an electrostatic charge of the opposite polarity on the lower surfaces thereof;
3. transferring a portion of the charge on the upper surface of said first insulative layer to the electrically conductive layer; and
4. selectively exposing said photoconductive layer to radiation.

26. The process recited in claim 25 wherein said insulative layers are each formed from poled, pyroelectric material, are arranged in said medium with their dipoles oriented in the same direction, and are charged by the method of:

(1) changing the temperature of said insulative layers from an ambient temperature to form an electrostatic charge of one polarity on each of the upper surfaces of said insulative layers and an electrostatic charge of the opposite polarity on each of the lower surfaces thereof;
(2) discharging the upper and lower surfaces of said insulative layers by momentarily shorting the upper and lower surfaces of each of said insulative layers together; and
(3) returning said insulative layers to said ambient temperature subsequent to the discharging thereof.

27. A photoconductive-pyroelectric copy medium comprising:

a first poled layer of pyroelectric material having substantially the same electrical resistance whether or not it is exposed to light;
an electrically conductive layer;
a photoconductive layer interposed between said pyroelectric layer and said electrically conductive layer, and electrically connected thereto; and
one of said pyroelectric and conductive layers is radiation transmissive to permit the exposure of radiation of said photoconductive layer.

28. The copy medium recited in claim 27 wherein there is a second poled layer of pyroelectric material that is interposed between said photoconductive layer and said electrically conductive layer.

29. The copy medium recited in claim 28 wherein said photoconductive layer contains interspersed groups of color sensitive areas, each group including areas that are each sensitive to different colors.

30. A photoconductive-pyroelectric copy medium comprising:

a first poled, radiation transmissive layer of pyroelectric material having substantially the same electrical resistance whether or not it is exposed to light;
a photoconductive layer that is juxtaposed with said pyroelectric layer;
a second poled layer of pyroelectric material that is juxtaposed with said photoconductive layer and has substantially the same electrical resistance whether or not it is exposed to light; and
an electrically conductive layer that is juxtaposed with said second pyroelectric layer.

31. A photoconductive-pyroelectric color copy medium comprising:

a poled, light transmissive layer of pryroelectric material;
an electrically conductive layer; and
a plurality of photoconductive layers interposed between and electrically connected with said pyroelectric layer and said electrically conductive layer, which photoconductive layers are each sensitive to a different color.

32. A photoconductive-pyroelectric color copy medium comprising:

a poled layer of pyroelectric material;
an electrically conductive layer;
a plurality of photoconductive layers interposed between said pyroelectric layer and said electrically conductive layer and electrically connected therewith, which layers are each sensitive to a different color; and
one of said electrically conductive and pyroelectric layers is radiation transmissive to permit the exposure to light of said photoconductive layers.

33. A photoconductive-pyroelectric color copy medium comprising:

a first poled, radiation transmissive layer of pryroelectric material;
an electrically conductive layer;
a plurality of photoconductive layers interposed between said first pyroelectric layer and said electrically conductive layer and electrically connected therewith, which layers are each sensitive to a different color; and
a second poled layer of pyroelectric material that is interposed between said electrically conductive layer and said plurality of said photoconductive layers.

34. A photoconductive-pyroelectric copy medium comprising:

a poled layer of pyroelectric material having substantially the same electrical resistance whether or not it is exposed to light;
a photoconductive layer in surface-to-surface contact with said pyroelectric layer;

an electrically conductive layer in surface-to-surface contact with said photoconductive layer; and one of said pyroelectric and conductive layers is radiation transmissive to permit the exposure to radiation of said photoconductive layer, and all of said layers are electrically connected to the layers with which they are in surface-to-surface contact.

35. A process for producing a latent electrostatic color image on the surface of an insulative layer forming a portion of a copy medium that also includes an electrically conductive layer, and a plurality of photoconductive layers interposed between said insulative layer and said electrically conductive layer, one of which insulative and conductive layers is light transmissive, and each of said photoconductive layers is sensitive to a single but different color of light, which process comprises the steps of:

1. electrically connecting said electrically conductive layer to ground;

2. forming an electrostatic charge of one polarity on the upper surface of said insulative layer and an electrostatic charge of the opposite polarity on the lower surface thereof;

3. momentarily electrically connecting the upper charged surface of said insulative layer to ground, and selectively exposing said photoconductive layer with a colored image image substantially at the same time;

4. flooding each of said photoconductive layers with the color to which each photoconductive layer is sensitive, one at a time;

5. subsequent to said flooding of each photoconductive layer, powdering the upper surface of said insulative layer with a colored toner powder to form a portion of the colored image on said insulative layer; and

6. transferring said portion of said colored image to a copy surface.

36. A photoconductive color copy medium comprising:

an insulative layer;

an electrically conductive layer; and a plurality of photoconductive layers interposed between and electrically connected with said insulative layer and said electrically conductive layer, which photoconductive layers are each sensitive to a different color.

* * * * *

UNITED STATES PATENT AND TRADEMARK OFFICE

CERTIFICATE OF CORRECTION

PATENT NO. : 3,992,204

DATED : November 16, 1976

INVENTOR(S) : Allen L. Taylor

It is certified that error appears in the above-identified patent and that said Letters Patent are hereby corrected as shown below:

Column 1, line 49, change "musst" to -- must --.

Column 3, line 50, change "layerr" to -- layer --.

Column 6, line 4, change "through" to -- though --.

Column 7, line 56, change "in" to -- is --.

Column 9, line 44, change "tissur" to -- tissue --.

Column 10, line 27, after "on"insert "a".

Column 11, line 42, change "form" to -- from --.

Column 11, line 61, after "$CdS_{1-x}$" delete the ",".

Column 12, line 36, change "elctrically" to -- electrically --.

Column 13, line 22, after "insulative" add -- layer --.

Column 13, line 40, change "an" (first occurrence) to -- and --.

Column 16, line 39, after "surfaces" delete the ",".

Signed and Sealed this

Eighth Day of March 1977

[SEAL]

*Attest:*

RUTH C. MASON
*Attesting Officer*

C. MARSHALL DANN
*Commissioner of Patents and Trademarks*